US006550650B2

(12) United States Patent
Fortier

(10) Patent No.: US 6,550,650 B2
(45) Date of Patent: Apr. 22, 2003

(54) NECKTIE AND METHOD OF CONSTRUCTING A NECKTIE

(76) Inventor: Robert Fortier, 1 Hammond Pl., Boynton Beach, FL (US) 33426-7754

( * ) Notice: Subject to any disclaimer, the term of this patent is extended or adjusted under 35 U.S.C. 154(b) by 0 days.

(21) Appl. No.: 09/833,354

(22) Filed: Apr. 12, 2001

(65) Prior Publication Data

US 2002/0148030 A1 Oct. 17, 2002

(51) Int. Cl.[7] ..... D06C 15/00
(52) U.S. Cl. ..... 223/81; 223/82; 2/146
(58) Field of Search ..... 2/146; 223/81, 223/82

(56) References Cited

U.S. PATENT DOCUMENTS

| | | | | |
|---|---|---|---|---|
| 1,176,391 | A | | 3/1916 | Meyer |
| 1,180,834 | A | | 4/1916 | Frank |
| RE14,142 | E | | 5/1916 | Keys |
| 1,273,263 | A | | 7/1918 | Mills |
| 1,535,669 | A | | 4/1925 | Kelly |
| 1,593,299 | A | | 7/1926 | Goldberg |
| 1,621,336 | A | | 3/1927 | Rutenberg |
| 1,721,333 | A | | 7/1929 | Cunningham |
| 1,998,143 | A | | 4/1935 | Newman |
| 2,004,490 | A | | 6/1935 | Lapham |
| 2,504,843 | A | | 4/1950 | Kaplan |
| 2,834,967 | A | | 5/1958 | Taksa |
| 2,887,687 | A | | 5/1959 | Bergheim |
| 3,321,773 | A | | 5/1967 | Orciuch |
| 3,797,044 | A | | 3/1974 | Chow |
| 3,950,790 | A | | 4/1976 | Adler |
| 4,696,064 | A | | 9/1987 | Morwood |
| 5,088,119 | A | * | 2/1992 | Fortier ..... 2/146 |

* cited by examiner

*Primary Examiner*—Rodney M. Lindsey
*Assistant Examiner*—James G Smith
(74) *Attorney, Agent, or Firm*—Laurence A. Greenberg; Werner H. Stemer; Gregory L. Mayback

(57) ABSTRACT

A necktie includes a single-piece tie defining a display area and a knot area with the display area having a given pattern and the knot area having a pattern different from the given pattern. The one-piece tie can be woven or printed to produce the patterns. The tie can have a single-piece display-knot portion and a single-piece tail portion to be joined together. The tail portion can have a pattern, preferably, the same as the given pattern. A method of constructing a necktie includes cutting a tie from a single-piece of fabric having a given pattern at a display area and a pattern different from the given pattern at a knot area. The tie is folded lengthwise and is connected together at long edges. The edge-connected tie is turned inside out. Also, a single-piece display-knot portion can define the display and knot areas with the display-knot portion joined to a tail portion also preferably cut from a single-piece of fabric.

18 Claims, 3 Drawing Sheets

NECKTIE AND METHOD OF CONSTRUCTING A NECKTIE

BACKGROUND OF THE INVENTION

FIELD OF THE INVENTION

This invention relates to neckties, and more particularly, to neckties in which a different pattern is formed on the display portion of the necktie than the knot area.

Neckties are usually constructed from woven fabrics that have warp and weft threads making up the structure of the cloth. Neckties withstand the repeated tying and untying to which they are subject better, and retain an attractive drape, if they are cut on a bias, whereby the warp becomes neither vertical nor horizontal when the tie is worn, but assumes an oblique angle in the draped portion of the tie. Many neckties have a decorative figure woven into, or printed on, the fabric in a pattern that repeats consistently in the draped display that hangs in front of the wearer, below the knot. At the knot, however, the decorative pattern is broken since the pattern is rotated 90 degrees in the knot; thus, stripes which are horizontal in the drape tend to be vertical in the knot and vice versa.

The fabric of some neckties has a solid color, while other neckties utilize a fabric having a 360-degree symmetrical pattern or a paisley pattern. For these types of neckties, the knot has the same pattern orientation as the draped display. In addition, some ties utilize a variety of different colors therein in the patterns thereof. For the single color fabric, the color of clothing with which the tie may be worn may be limited, whereas the tie of multiple colors may be worn with various different colors of clothing. However, even with the multi-colored neckties, some colors are more predominant than others and only the most predominant are commonly matched with other clothing.

In prior art neckties the knot does not have the conventional pattern found with a necktie having the same pattern throughout. For example, French Patent 968,599 to Dumas, published Nov. 30, 1950, discloses a necktie knot having stripes in the same direction as the striped drape. A similar disclosure is contained in French Patent 1,365,488 to Martin, published May 25, 1964. In both of these patents, the tie is divided into two portions, resulting in the tail appearing different than the front. Thus, the conventional 90-degree pattern rotation found in a knot is replaced by a 180-degree rotation in the tail.

Other prior art neckties are made of various pieces, particularly in the neck area. For example, U.S. Pat. No. Re. 14,142 to Keys discloses a necktie having a silk strip in the area of the necktie that fits around the collar to permit easier sliding of the necktie to center the knot. A similar structure is disclosed in U.S. Pat. No. 1,621,336 to Rutenberg, which shows the lining exposed in the neck area. In both of these patents, the knot is not affected by the different material.

Other prior art ties are made of different materials for the front and back pieces to effectively permit one tie to appear as one of two different colors in a single unit. Such a tie may be found, for example, in U.S. Pat. No. 2,004,490 to Lapham.

No prior art necktie, however, permitted any desired pattern to be present in the knot without affecting the remainder of the tie. What was needed was a necktie having a knot that could appear as stripes in the same direction as the body, or a knot having a contrasting or coordinating solid color relative to the remainder of the necktie, or even a necktie in which the pattern in the knot may be selectively changed by the user. My patent, which issued on Feb. 18, 1992, with U.S. Pat. No. 5,088,119 solved this problem. My patent is briefly described below with reference to the figures of the drawings.

FIG. 1 illustrates a display portion 11 of my patented necktie cut to a set pattern from a supply of fabric. FIG. 2 illustrates a knot portion 12 of my necktie, and FIG. 3 shows a tail portion 13. Both the knot portion 12 and the tail portion 13 have been cut from the same fabric. The fabric of the display portion 11 of FIG. 1 has its warp threads 14 sloping upwardly to the right. The same holds true for the warp threads 14 of the tail portion 13. However, in the knot portion 12, the pattern has been so cut from the fabric so that the warp 14 appears sloping upwardly toward the left. Thus, the angle 16 of the warp 14 from a line 17 marking the lengthwise direction of the display portion 11 differs by ninety degrees (90°) from an angle 18 between the warp 14 of the knot portion 12 and a line 19 marking its lengthwise direction. The equivalent angle 21 of the tail portion 13 is ninety degrees smaller than the angle 18.

FIG. 4 differs from FIGS. 2 and 3 in that the knot and tail portions are continuous to form a knot-tail portion 22. Thus, the angle 23 between the warp 14 of the knot-tail portion 22 and a line51 marking its lengthwise direction is the same as the angle 18 between the warp 14 of the knot portion 12 and the line 19.

Border strips 24, 26, 27, 28 mark the ends of the portions 11, 12, 13, and 22 that must be pieced together. The border strips 24, 26, 27, 28 are shown turned up in FIG. 5 and are sewn together by rows of stitching 29, 31. Adhesive bonding or stapling also can be used to connect the respective portions 11, 12, 13, 22. Lengthwise border strips 32, 33; 34, 36; 37, 38; 39, 41 are provided for sewing the edges of the pattern cuts together along fold lines 42, 43; 44, 46; 47, 48; 49, 51.

After the border strips 32, 34, 37 have been sewn to the respective strips 33, 36, 39, the assembly of the portions 11, 12, 13 are turned inside out in a conventional manner to complete a tie. Conventional steps of ironing and adding stiffening strips, facings, and linings can then be performed.

FIGS. 6 and 7 show various embodiments resulting from my patent. Specifically, in FIG. 6, the portions 11, 12, 13 have been sewn into a necktie having a design 52 including a succession of parallel, diagonal stripes. It can be seen in FIG. 6 that the stripes on the display portion 11 have the same orientation in both the formed knot 12 and the tail portion 13. In FIG. 7 a tie including portions 11 and 22 also continues the orientation of the draped display in the knot but the orientation of the stripes is reversed in the tail portion 22.

However, there are two disadvantages associated with my patented necktie. First, when three portions 11, 12, 13 are used to create a tie, as shown in FIGS. 5 and 6, two seams are produced. The manufacturing costs associated with connecting these two seams are substantial, when compared with the overall cost of a typical tie. Second, when two portions 11, 22 are used to create a tie, as shown in FIG. 7, only one seam is produced. However, when the formed knot is required to have the same orientation as the display portion 11, the displayed tail part of the knot-tail portion 22 is then oriented differently from the design of the display portion 11. Accordingly, there is a need to solve both these disadvantages and produce a tie that only requires one seam and that also easily permits the tail portion to be oriented in any way desired by the user.

SUMMARY OF THE INVENTION

It is accordingly an object of the invention to provide a necktie and method of constructing a necktie that overcomes the hereinafore-mentioned disadvantages of the heretofore-known devices of this general type and that reduces the manufacturing steps and cost for producing a multi-pattern and/or multi-color necktie.

With the foregoing and other objects in view, there is provided, in accordance with the invention, a necktie including a single-piece display-knot portion defining a display area and a knot area and having a knot joining edge, a single-piece tail portion having a tail joining edge joined to the knot joining edge. The display area has a given pattern, and the knot area has a pattern different from the given pattern.

Pattern, as used herein, includes not only the presence of markings and/or colors, but also the absence of both markings and colors. For example, a pattern can include a paisley design, diagonal stripes, and any single solid color. A pattern can also include the absence of any additional markings or colors to the fabric or material of the tie.

Because the features of the invention relate particularly to the display and knot portions of the tie, the invention can be used with clip-on ties and zipper ties, many of which only have knot and display portions and do not have neck or tail portions.

In accordance with another feature of the invention, a tail portion has the given pattern.

In accordance with an added feature of the invention, the display-knot portion has a given length, and the tail portion has a length substantially equal to the given length. Preferably, the display area has a length of approximately 51 cm, the knot area has a length of between 20 to 28 cm, particularly, 23 cm, and the tail portion has a length of approximately 74 cm.

In accordance with yet another feature of the invention, the knot joining edge is sewn, glued, and/or stapled to the tail joining edge.

In accordance with yet a further feature of the invention, the display-knot portion is made from a fabric having warp threads oriented in a given direction, and the tail portion is made from a fabric having warp threads oriented in the given direction.

In accordance with yet an added feature of the invention, the display-knot portion and the tail portion are made from a woven fabric having a warp cut from a uniform supply of the fabric. Preferably, the warp of the tail portion is aligned with the warp of the display-knot portion.

With the objects of the invention in view, there is also provided a necktie including a single-piece tie defining a display area, a knot area, and a tail area. The display area has a first pattern, the knot area has a second pattern different from the first pattern, and the tail area has a third pattern. Preferably, the third pattern is the same as the first pattern.

With the objects of the invention in view, there is also provided a necktie including a single-piece display-knot portion defining a display area and a knot area, with the display area having a given pattern, and the knot area having a pattern different from the given pattern.

With the objects of the invention in view, there is also provided a method of constructing a necktie including the steps of cutting a display-knot portion from a single-piece of fabric having a given pattern and at least one pattern different from the given pattern. The display-knot portion defines a display area having the given pattern and a knot area having a pattern different from the given pattern. The display-knot portion has a knot joining edge. A tail portion having a tail joining edge is cut from a single-piece of fabric. The tail joining edge is joined to the knot joining edge to form a joined portion having long edges. The joined portion is folded lengthwise and is connecting together the long edges. Finally, the edge-connected joined portion is turned inside out.

In accordance with yet an additional mode of the invention, the fabric is a woven fabric. The method also includes weaving the given pattern and the different pattern in the woven fabric.

In accordance with again another mode of the invention, the given pattern and the different pattern are printed on the fabric. Preferably, the patterns are simultaneously printed on the fabric.

In accordance with again a further mode of the invention, the display-knot portion is cut to provide the knot area with a length of length of between 20 to 28 cm, particularly, 23 cm, and the display area with a length of approximately 51 cm, and the tail portion is cut to a length of approximately 74 cm. Preferably, the tail portion is cut to a length equal to the display-knot portion.

With the objects of the invention in view, there is also provided a method of constructing a necktie including the steps of cutting a tie from a single-piece of fabric having a given pattern and at least one pattern different from the given pattern, the tie having long edges and defining a display area having the given pattern and a knot area having a pattern different from the given pattern, folding the tie lengthwise and connecting together the long edges, and turning the edge-connected tie inside out.

With the objects of the invention in view, there is also provided a method of constructing a necktie including the steps of weaving a one-piece tie with long edges to produce a display area having a given pattern and a knot area having a pattern different from the given pattern, folding the tie lengthwise and connecting together the long edges, and turning the edge-connected tie inside out.

In accordance with again an added mode of the invention, there is provided the step of weaving the one-piece tie to produce a tail area having the given pattern.

With the objects of the invention in view, there is also provided a method of constructing a necktie including the steps of selecting fibers to weave a first pattern for a display part of a tie, changing the fibers to weave a second pattern for a knot part of the tie, and changing the fibers to weave a third pattern in a tail part of the tie, the display part, knot part, and tail part defining long edges, folding the tie lengthwise and connecting together the long edges, and turning the edge-connected tie inside out.

With the objects of the invention in view, there is also provided a method of constructing a necktie including the steps of producing a one-piece tie defining long edges, a display area, and a knot area, printing a given pattern at the display area, printing a pattern different from the given pattern at the knot area, folding the tie lengthwise and connecting together the long edges, and turning the edge-connected tie inside out.

With the objects of the invention in view, there is also provided a method of constructing a necktie including the steps of producing a one-piece tie defining long edges, a display area, and a knot area, printing a given pattern at the display area, printing a pattern different from the given pattern at the knot area, folding the tie lengthwise and connecting together the long edges, and turning the edge-connected tie inside out.

With the objects of the invention in view, there is also provided a method of constructing a necktie including the steps of producing a one-piece tie defining long edges, a display area, a knot area, and a tail area, simultaneously printing a first pattern at the display area, a pattern different from the first pattern at the knot area, and a second pattern at the tail area, folding the tie lengthwise and connecting together the long edges, and turning the edge-connected tie inside out.

Other features that are considered as characteristic for the invention are set forth in the appended claims.

Although the invention is illustrated and described herein as embodied in a necktie and method of constructing a necktie, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIEMTNS

Figure 1:
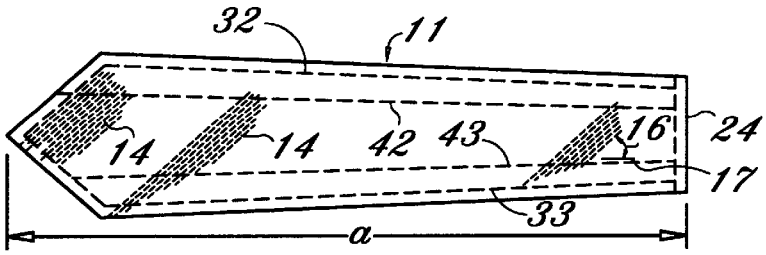
FIG. 1 is a plan elevational view of a pattern-cut display portion of a necktie.
Figure 2:
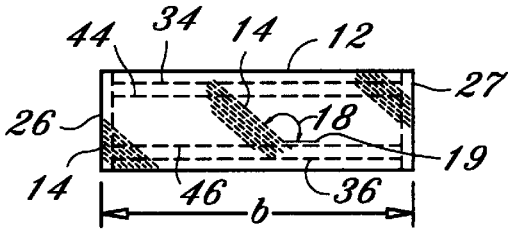
FIG. 2 is a plan elevational view of a pattern-cut knot portion of a necktie.

In all the figures of the drawing, sub-features and integral parts that correspond to one another bear the same reference symbol in each case.

Figure 8:
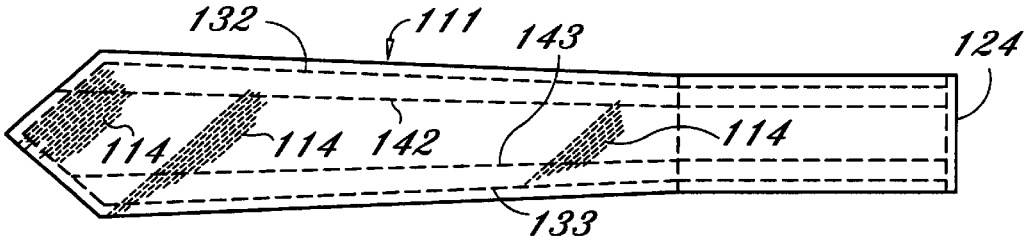
FIG. 8 is a plan elevational view of a display-knot portion of the necktie according to the invention.

Referring now to the figures of the drawings in detail and first, particularly to FIG. 8 thereof, there is shown a display-knot portion 110 having a display part 111 and a knot part 112. The fabric of the display-knot portion 110 of FIG. 8 has its warp threads 114 sloping upwardly to the right. This holds true for the warp threads 114 of both the display part 111 and the knot part 112.

Figure 9:
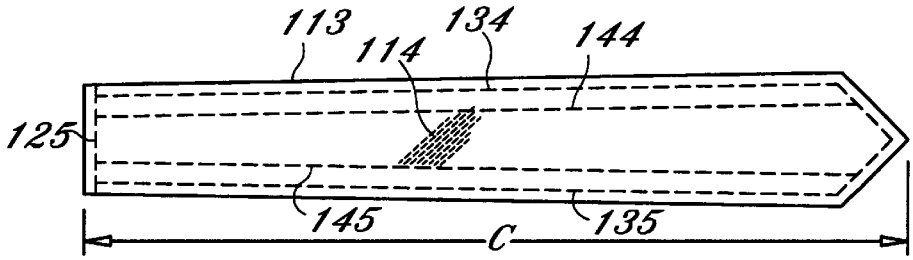
FIG. 9 is a plan elevational view of a tail portion of the necktie according to the invention.

FIG. 9 shows a tail portion 113. The fabric of the tail portion 113 of FIG. 1 has its warp threads 114 sloping upwardly to the right, although, for the invention, the relative direction of the warp threads 144 of the tail portion 113 and the display-knot portion 110 can be as desired.

Figure 10:
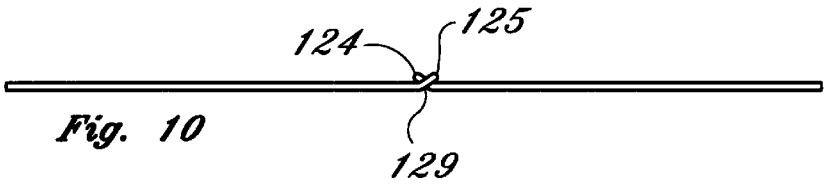
FIG. 10 is a side-elevational view of the display-knot portion of FIG. 8 and the tail portion of FIG. 9 connected according to the invention.

The ends of the portions 110, 113 that must be pieced together are marked by border strips 124, 125. The border strips 124, 125 are shown turned up in FIG. 10 and are sewn together by a row of stitching 129. Adhesive bonding or stapling also can be used to connect the respective portions 110, 113. Similarly, any conventional fabric fastener can be used to connect the respective portions 110, 113. Lengthwise border strips 132, 133; 134, 135 are provided for sewing the edges of the pattern cuts together along fold lines 142, 143; 144, 145.

After the border strips 132, 134 have been sewn to the respective border strips 133, 135, the assembly of the display-knot and tail portions 110, 113 is turned inside out in a conventional manner to complete the tie. Conventional steps of ironing and adding stiffening strips, facings, and linings can be performed.

The above description relates to the construction of the tie according to the invention. Now, the creation/formation of the displayed aesthetic pattern is discussed.

Figure 3:
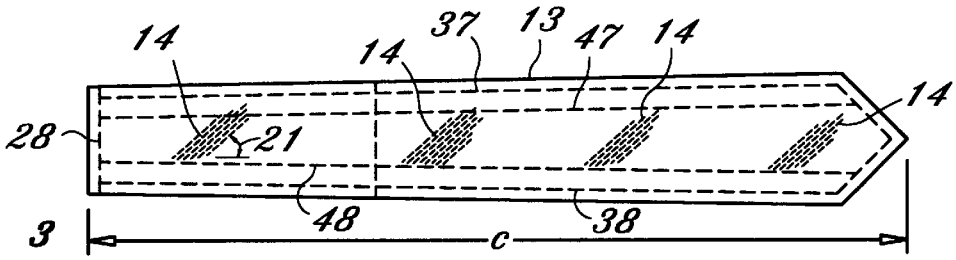
FIG. 3 is a plan elevational view of a pattern-cut tail portion of a necktie.
Figure 4:
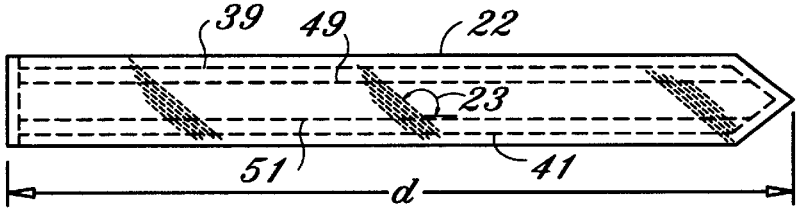
FIG. 4 is a plan elevational view of a pattern-cut combined knot and tail portion of a necktie.
Figure 5:
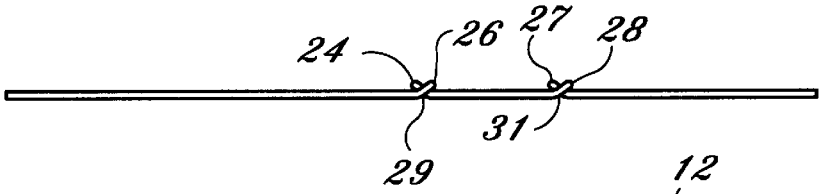
FIG. 5 is an edge elevational view of the display, knot, and tail portions of FIGS. 1 to 3 prior to folding.
Figure 7:
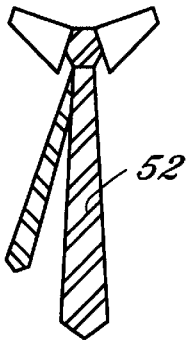
FIG. 7 is a plan, pictorial view of a knotted necktie including the portions shown in FIGS. 1 and 4.

The display-knot portion 110 of the invention is different from that described with respect to FIGS. 1 to 4 in that the combination piece is not, as shown in FIG. 3, the knot-tail portion 13. Rather, it is a portion 110 including the display area and the knot area. The display-knot portion 110 is constructed in one-piece, but displays two different patterns. In particular, the display-knot portion 110 can be woven or printed such that two patterns are displayed.

Ties are typically made of woven fibers, in particular, of woven silk fibers. Other fibers include cotton, polyester, and other man-made and natural fibers. These fibers can be colored. Thus, when knitting the fabric of the tie, same or different colors can be woven to create a single-color or multi-colored tie, respectively. In order to weave the display-knot portion 110 with two different patterns, the fibers are selected in one way to form a first pattern 115 for the display part 111 and are then changed to form a second pattern 116 for the knot part 112. Placing this construction in the example shown in FIG. 11, the fibers for the display part 111 are selected to form a striped pattern 115. Then, when the display part weaving reaches a given length A, defined by a boundary 117, the weaving fibers are changed to all have the same color 116. As the weaving continues, the knot part 112 is formed in one color.

In a preferred embodiment of the invention, the length "A" of the display part 111 of a finished tie is approximately 20 inches (51 cm), the length "B" of the knot part 112 is approximately 9 inches (23 cm), and the length "C" of the tail portion 113 is approximately 29 inches (74 cm), although it will be understood that these dimensions may vary with style within the scope of the subject invention. Generally, the knot part 112 will be between eight and eleven inches (20 to 28 cm) because such a length of material is needed to form the knot. Changes in tie widths will, of course, affect the length required for the knot part 112. The other dimensions are not as critical and will vary depending upon the length of the necktie desired. Generally, the sum of the length (A+B) of the knot part 112 and display part 111 will approximately equal the length C of the tail portion 113. It should be understood that the tail portion 113 includes both a neck part, which encircles the neck, and a tail part, which extends downward behind the display part 111.

Additionally or alternatively, the display-knot portion 110 can be printed to have two distinctly different patterns. Specifically, the display part 111 can have a particular aesthetic print and the knot part 112 can have a different aesthetic print. If a printing method is used to create the aesthetic pattern of the tie, such as silk screening, for example, then the pattern is printed in two parts. A first pattern part 115 is printed on the display part 111 and a second pattern part 116 is printed on the knot part 112. Such patterns include, for example, airplanes on the display part 111 and clouds on the knot part 112, golf flags on the display part 111 and golf balls on the knot part 112, musical instruments on the display part 111 and musical notes on the knot part 112, and/or diagonal lines in a given direction on the display part 111 and diagonal lines in the given direction or another direction on the knot part 112.

Figure 11:
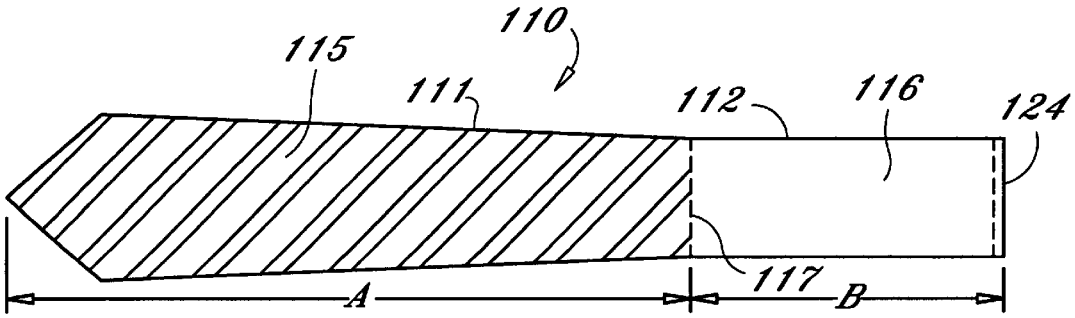
FIG. 11 is a plan elevational view of an alternative embodiment of the display-knot portion of FIG. 8 according to the invention.

Applying the printing method to the example shown in FIG. 11, the display part 111 has a striped pattern 115 printed up to the boundary 117. From the boundary 117 to the end of the knot part 112, a solid color 116 is printed.

The above-mentioned embodiments of the invention related to a two-part tie, each of the parts having an end that must be pieced together at the border strips 124, 125. As set forth above, the invention generates substantial savings in cost because it eliminates a joining seam. Using the weaving and printing steps as set forth above allows the invention to entirely eliminate all joining seams. Such a process is explained with respect to FIG. 12 in the following text.

Figure 12:
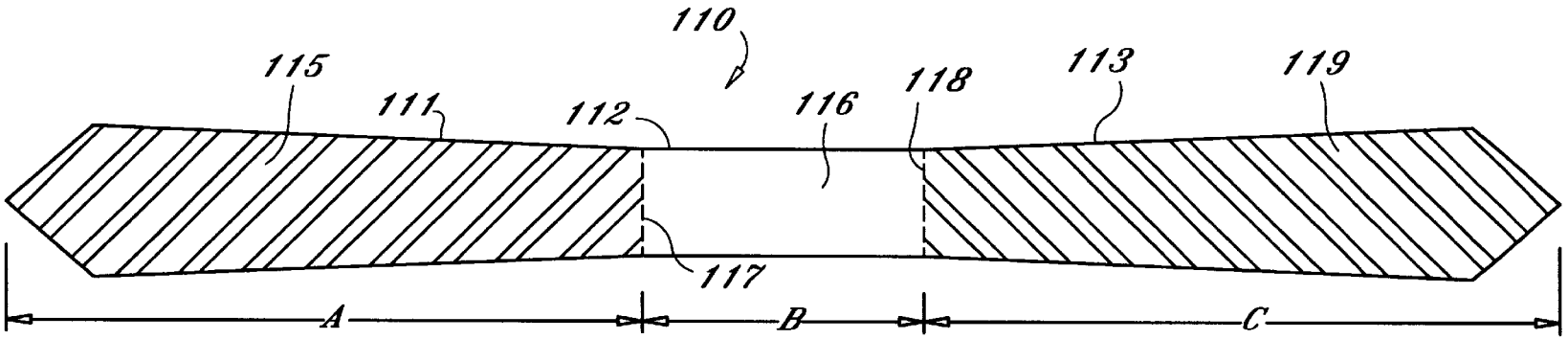
FIG. 12 is a plan elevational view of a one-piece necktie according to the invention.

FIG. 12 shows a one-piece necktie including a display-knot portion 110 and a tail portion 113.

In order to weave the one-piece necktie with two different patterns—one pattern in the knot part 112 and one pattern in both the display part 111 and the tail portion 113—the fibers are selected in one way to form a first pattern 115 for the display part 111. The fibers are then changed to form a second pattern 116 for the knot part 112. Finally, the fibers are again changed to form the first pattern 115 in the tail portion 113.

Figure 6:
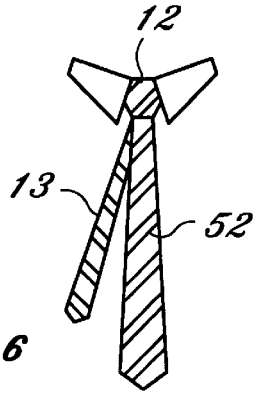
FIG. 6 is a plan, pictorial view of a knotted necktie including the portions shown in FIGS. 1 to 3.

Placing this construction in the example shown in FIG. 12, the fibers for the display part 111 are selected to form a striped pattern 115. Then, when the display part weaving reaches a given length A, defined by a boundary 117, the weaving fibers are changed to all have the same color 116. As the weaving continues, the knot part 112 is formed in one color. Then, at boundary 118, the fibers are changed back to the first pattern of the display part 111 to weave the tail portion 113. Advantageously, however, if the pattern is a diagonal stripe, then the weaving is performed to make the diagonal in the opposite direction 119 with respect to the display part 111. Thus, when the tie is tied, the two diagonals will be aligned as illustrated in FIG. 6.

If a printing method is used to create the aesthetic pattern of the tie, then the pattern is printed in three parts. A first pattern 115 is printed on the display part 111, a second pattern 116 is printed on the knot part 112, and a third pattern 119 is printed on the tail portion 113. Applying the printing method to the illustrative example shown in FIG. 12, the display part 111 is printed with a diagonally striped pattern 115 up to the boundary 117. From the first boundary 117 to second boundary 118, a solid color 116 is printed at the knot part 112. Finally, an oppositely directed diagonal striped pattern 119 is printed at the tail portion 113 such that, when tied, the pattern of the tail portion 113 matches the pattern of the display part 111.

In either printing or weaving, the tail portion 113 pattern does not necessarily have to match the pattern of the display part 111.

The necktie and method of constructing the necktie, therefore, eliminates expensive construction steps while simultaneously expands the aesthetic properties and differences of an individual necktie.

I claim:

1. A necktie, comprising:

a single-piece display-knot portion defining a display area and a knot area and having a knot joining edge;

a single-piece tail portion having a tail joining edge joined to said knot joining edge;

said display area having a given pattern; and said knot area having a pattern different from said given pattern.

2. The necktie according to claim 1, wherein said tail portion has said given pattern.

3. The necktie according to claim 1, wherein said knot portion has a length of between 20 to 28 cm.

4. The necktie according to claim 1, wherein:

said display-knot portion has a given length; and said tail portion has a length substantially equal to said given length.

5. The necktie according to claim 1, wherein:

said display area has a length of approximately 51 cm;

said knot area has a length of approximately 23 cm; and said tail portion has a length of approximately 74 cm.

6. The necktie according to claim 1, wherein said knot joining edge is sewn to said tail joining edge.

7. The necktie according to claim 1, wherein said knot joining edge is glued to said tail joining edge.

8. The necktie according to claim 1, wherein said knot joining edge is stapled to said tail joining edge.

9. The necktie according to claim 1, wherein:

said display-knot portion is made from a fabric having warp threads oriented in a given direction; and said tail portion is made from a fabric having warp threads oriented in said given direction.

10. The necktie according to claim 1, wherein said display-knot portion and said tail portion are made from a woven fabric having a warp cut from a uniform supply of said fabric.

11. The necktie according to claim 10, wherein said warp of said tail portion is aligned with said warp of said display-knot portion.

12. A necktie, comprising:

a single-piece tie defining a display area, a knot area, and a tail area;

said display area having a first pattern;

said knot area having a second pattern different from said first pattern; and said tail area having a third pattern.

13. The necktie according to claim 12, wherein said third pattern is said first pattern.

14. The necktie according to claim 12, wherein said knot area has a length of between 20 to 28 cm.

15. The necktie according to claim 12, wherein:

said display area has a first length;

said knot area has a second length; and said tail area has a third length substantially equal to a sum of said first length and said second length.

16. The necktie according to claim 12, wherein:

said display area has a length of approximately 51 cm;

said knot area has a length of approximately 23 cm; and said tail area has a length of approximately 74 cm.

17. The necktie according to claim 12, wherein said tie is made from a fabric having warp threads oriented in a given direction.

18. A necktie, comprising:

a single-piece display-knot portion defining a display area and a knot area;

said display area having a given pattern; and said knot area having a pattern different from said given pattern.

* * * * *